US006520896B1

(12) United States Patent
Sohl

(10) Patent No.: US 6,520,896 B1
(45) Date of Patent: Feb. 18, 2003

(54) ELASTIC ROLL AND A PROCESS FOR PRODUCING SUCH A ROLL

(75) Inventor: Carsten Sohl, Fredericia (DK)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 26 days.

(21) Appl. No.: 09/598,909

(22) Filed: Jun. 22, 2000

(30) Foreign Application Priority Data

Jun. 23, 1999 (DE) ..... 199 28 753

(51) Int. Cl.[7] ..... B25F 5/02

(52) U.S. Cl. ..... 492/45; 492/50

(58) Field of Search ..... 492/39, 38, 40, 492/45, 50, 49, 41; 101/375

(56) References Cited

U.S. PATENT DOCUMENTS

| | | | | | |
|---|---|---|---|---|---|
| 732,728 | A | * | 7/1903 | Forsyth | 492/40 |
| 801,576 | A | * | 10/1905 | Elixman et al. | 242/599.2 |
| 1,591,897 | A | * | 7/1926 | Vincke | 492/38 |
| 2,005,885 | A | * | 6/1935 | Brindley | 492/45 |
| 2,107,471 | A | * | 2/1938 | Crysler et al. | 492/41 |
| 2,720,692 | A | * | 10/1955 | Lorig | 29/895.213 |
| 2,921,893 | A | * | 1/1960 | Smith | 204/206 |
| 2,987,802 | A | * | 6/1961 | Quinn | 492/40 |
| 3,111,742 | A | * | 11/1963 | Lakin | 492/40 |
| 3,365,774 | A | | 1/1968 | Kusters | |
| 3,982,312 | A | * | 9/1976 | Finzer | 492/56 |
| 4,150,622 | A | * | 4/1979 | Stollenwerk et al. | 101/378 |
| 4,299,022 | A | * | 11/1981 | Kummerl | 29/450 |
| 4,491,082 | A | * | 1/1985 | Barch et al. | 101/375 |
| 4,551,894 | A | | 11/1985 | Beucker | |
| 4,651,643 | A | * | 3/1987 | Katz et al. | 101/375 |
| 4,669,163 | A | * | 6/1987 | Lux et al. | 492/41 |
| 4,990,963 | A | * | 2/1991 | Yamamoto et al. | 492/59 |
| 5,038,448 | A | * | 8/1991 | Gusmer | 492/41 |
| 5,045,891 | A | * | 9/1991 | Senba et al. | 399/331 |
| 5,097,596 | A | * | 3/1992 | Hoogesteger et al. | 29/895.21 |
| 5,216,954 | A | * | 6/1993 | Thompson | 101/375 |
| 5,307,563 | A | * | 5/1994 | Svenka | 29/895.213 |
| 5,334,124 | A | * | 8/1994 | Ohno | 492/50 |
| 5,387,172 | A | * | 2/1995 | Habenicht et al. | 492/50 |
| 5,439,435 | A | * | 8/1995 | Curtis et al. | 492/41 |
| 5,461,464 | A | * | 10/1995 | Swain | 492/45 |
| 5,558,610 | A | * | 9/1996 | Byung-Gie et al. | 492/45 |
| 5,722,924 | A | * | 3/1998 | Hill et al. | 492/38 |
| 5,740,738 | A | * | 4/1998 | Niemiro | 101/376 |
| 5,759,141 | A | * | 6/1998 | Schmitz | 492/39 |
| 5,790,926 | A | * | 8/1998 | Mizoe et al. | 492/50 |
| 5,904,095 | A | * | 5/1999 | Nelson | 101/375 |
| 6,073,548 | A | * | 6/2000 | Kayser et al. | 492/59 |
| 6,161,478 | A | * | 12/2000 | Katz | 101/375 |
| 6,283,026 | B1 | * | 9/2001 | Tocheport et al. | 101/375 |

FOREIGN PATENT DOCUMENTS

| | | | |
|---|---|---|---|
| DE | 1807331 | 6/1970 | |
| DE | 2052249 | 4/1972 | |
| DE | 2316746 | 10/1974 | |
| DE | 3029288 | 3/1981 | |
| DE | 3703564 | 8/1987 | |
| DE | 3832999 | 4/1990 | |
| DE | 29880097 | 9/1999 | |
| GB | 968938 | 9/1964 | |
| JP | 401316414 A | * 12/1989 | 492/45 |

* cited by examiner

*Primary Examiner*—Gregory M. Vidovich
*Assistant Examiner*—Marc Jimenez
(74) *Attorney, Agent, or Firm*—Greenblum & Bernstein, P.L.C.

(57) ABSTRACT

A roll for smoothing of a material web and a process for making the roll. The roll includes a hard roll core having an outside surface, and an covering layer includes an elastic matrix material and disposed on the outside surface, wherein the covering layer is rotationally fixed and longitudinally displaceable on the hard roll core. The process includes applying the covering layer on the outer surface of the hard roll core, wherein the elastic covering layer is rotationally fixed and longitudinally displaceable on the outside surface of the hard roll core.

35 Claims, 2 Drawing Sheets

ELASTIC ROLL AND A PROCESS FOR PRODUCING SUCH A ROLL

CROSS-REFERENCE TO RELATED APPLICATIONS

The present application claims priority under 35 U.S.C. §119 of German Patent Application No. 199 28 753.8, filed on Jun. 23, 1999, the disclosure of which is expressly incorporated by reference herein in its entirety.

BACKGROUND OF THE INVENTION

1. Field of the Invention

The present invention relates to a roll of the type used for smoothing paper webs. The roll has a hard roll core which can be a metal and an outside surface utilizing an elastic covering layer. The covering layer may be an elastic matrix material. Furthermore, the invention is directed to a process for producing such a roll.

2. Discussion of Background Information

Elastic rolls of this kind are used, for example, in the satining of paper webs. In such cases, one elastic roll forms, in each case together with a hard roll, a press gap through which the paper web to be treated is guided. The hard roll typically has a very smooth surface made, for example, of steel or chilled cast iron and is responsible for the smoothing of that side of the paper web facing it. The elastic roll acting on the opposite side of the paper web effects a homogenizing and compacting of the paper web in the nip. The size of the rolls can typically range from lengths of approximately 3 to approximately 12 m and the diameters can vary from approximately 450 to approximately 1500 mm. Moreover, they can withstand line forces of up to approximately 600 N/mm and compressive stresses of up to approximately 130 $N/mm^2$.

As the trend in paper manufacturing is on performing satining in an online operation, i.e. towards guiding the paper web exiting a paper machine or coating machine directly through a paper smoothing apparatus (e.g., a calender), higher demands than were previously made are put on the rolls of the smoothing apparatus. This is particularly true with regard to temperature resistance. Further, as a result of the high transportation speeds of the paper web required in online operation and the high rotation speeds of the calender rolls associated with this design, its nip frequency, that is the frequency with which the covering is compressed and relieved of its load again, is increased. This in turn leads to increased roll temperatures. However, these higher temperatures which arise in online operations, lead to problems which can lead to the destruction of the plastic coatings in conventional elastic rolls.

On the one hand, conventional plastic coatings may withstand maximum temperature differences of around approximately 20° C. over the width of the roll. On the other hand, the plastics which are conventionally used for the coating have a substantially higher coefficient of thermal expansion than the conventionally used steel rolls or chilled cast-iron rolls. Accordingly, due to an increase in temperature, high axial stresses occur between the steel roll or the chilled cast-iron roll and the plastic coating associated with it. Additionally, so-called hot spots, at which a peeling or even a breaking open of the plastic layer occurs, often arise due to these high stresses in conjunction with hot regions occurring particularly in spot-form.

These hot spots occur, in particular, when in addition to the mechanical stresses and the relatively high temperature, crystallization spots exist in the form of, for example, defective adhesive bonds, deposits or above-average recesses in the elastic coating. These may be, for example, due to creases or foreign bodies on the paper web. In such cases, the temperature at the crystallization spots can increase from a normal temperature in the range of approximately 80° C. to approximately 90° C. to more than approximately 150° C. Accordingly, this can cause the above-mentioned destruction of the plastic layer to occur.

SUMMARY OF THE INVENTION

The present invention provides a process for producing a roll of the above mentioned type. Moreover, the invention is also directed to a corresponding roll. The roll of the invention is designed to withstand the formation or occurrence hot spots.

The invention is therefore directed to a roll which utilizes an elastic covering layer which is rotationally fixedly, but longitudinally displaceably arranged on the roll core. Moreover, the invention concerns a process of making a roll in which the elastic covering layer is applied to be longitudinally displaceable, but rotationally fixed to the roll core.

As a result of the elastic covering layer being arranged in accordance with the invention, i.e., longitudinally displaceably on the roll core, a situation is achieved in which none or very little longitudinal stresses occur between the roll core and the elastic covering layer. This will be the case even when the elastic roll-heats up, for example, such as when in operation.

This design allows the roll to heat up such that the elastic covering layer expands in an axial direction more than the roll core due to the higher coefficient of thermal expansion. However, the longitudinal displaceability of the covering layer, only leads to a relative movement occurring between the elastic covering layer and the roll core in an axial direction. In this design, either the two ends of the elastic covering layer can be axially displaced in opposite directions relative to the roll core or an asymmetrical longitudinal displacement of the elastic covering layer on the roll core can be allowed to occur. Depending on the different coefficients of thermal expansion and the temperatures which result, the relative displacement between the covering layer and the roll core can, for example, amount to around approximately 5 to approximately 50 mm, and commonly approximately 10 to approximately 20 mm.

In a roll designed in accordance with the invention, there is a stress-free connection between the elastic covering layer and the roll core. Accordingly, this design leads to a reduction in hot spots. Further, the risk of occurrence of a peeling of the covering layer from the roll core is significantly reduced and/or eliminated entirely.

By utilizing a rotationally fixed arrangement of the elastic covering layer on the roll core, it is ensured that, in operation, the covering layer is rotated securely together with the roll core as one unit. This ensures a uniform quality of the web of material which is to be smoothed.

According to one aspect of the invention, the elastic covering layer is disposed free from play on the roll core, in particular in force fit. A separation layer is preferably provided between the elastic covering layer and the roll core. This can, in particular, reduce the friction between the elastic covering layer and the roll core. This separation layer can advantageously include silicone and/or an essentially monomolecular layer and/or a corrosion- inhibiting or corrosion-preventing material.

As a result of the elastic covering layer being disposed free from play, e.g., in a force fit relationship, it is ensured that this layer lies positively over its whole circumference against the surface of the roll core. This is particularly important in a smoothing operation and when a relatively high mechanical load is placed on the covering layer. Any compression and/or crease formation in the covering layer, which can lead to a reduction in the quality of the treated material web, is thus prevented. Moreover, by utilizing a separation layer, for instance, the friction between the elastic covering layer and the roll core is reduced. Therefore, when the roll heats up, the desired longitudinal displacement can occur between the covering layer and the roll core.

However, it should be noted that the thinner the separation layer is designed here, the tighter the seating of the covering layer on the roll core. Moreover, due to the longitudinally displaceable support of the elastic covering layer on the roll core, it is generally possible for moisture to penetrate between the elastic covering layer and the roll core. This can allow for corrosion to arise on the metallic roll core. Accordingly, in an effort to prevent this, the separation layer can advantageously be formed from a corrosion-inhibiting or corrosion-preventing material.

The rotational fixation and simultaneous longitudinal displaceability of the elastic covering layer on the roll core can be advantageously achieved by rotational fixation and guide elements provided on the surface of the roll core and by counter-elements cooperating with these provided on the elastic covering layer. For example, one or more longitudinal guides extending essentially in an axial direction can be provided in and/or on the elastic covering layer. In particular, these can be in and/or on the radially inner surface of the elastic covering layer. Additionally, engaging elements, in particular, pin-like engaging elements, can be provided on the surface of the roll core so as to engage into them. In the same way, the longitudinal guides can be provided on the roll core while the engaging elements are provided on the elastic covering layer.

In one design, slot-like longitudinal guides and the pin-like engaging elements which engage into them provide for a simple rotational fixation with a simultaneous longitudinal displaceability of the elastic covering layer on the roll core. Generally, however, other designs are also possible which can achieve a rotational fixation with simultaneous longitudinal displaceability.

In accordance with another embodiment of the invention, one or more fiber layers are embedded in the matrix material of the elastic covering layer. Depending on the fiber material, the physical properties of the elastic covering layer can be preset by an embedding of the fiber layers. For example, by embedding fibers with a rigidity higher than that of the matrix material, the total rigidity of the elastic covering layer can be increased. In addition, the thermal conductivity of the elastic covering layer can be substantially increased over that of a covering layer of pure matrix material. Moreover, this can be accomplished by selecting fibers of high thermal conductivity. This can be particularly advantageous in the effort to improve the dissipation of excess heat.

Preferably, the fiber layers are formed at least partially by fiber bundles running obliquely to the surface of the roll core. These fiber layers can particularly include crossed fiber bundles. By utilizing crossed fiber bundles, a crossed assembly is created such that torsion of the elastic covering layer is largely avoided. Further, as the elastic covering layer in a roll designed in accordance with the invention is not fixedly connected to the surface of the roll core, any torsion of the freely displaceable covering layer is generally feasible. For this reason, the elastic covering layer should preferably be designed so that any torsion of the covering layer is counteracted.

Accordingly, the elastic covering layer can include a radially outer functional layer and a radially inner connection layer to connect the functional layer with the roll core. As a result of this two separate layer design, these layers can each be adapted in optimum fashion to their relevant tasks. It is possible, for example, for the radially outer functional layer to have a higher elasticity than the radially inner connection layer. Moreover, the latter can have, in turn, for example, a higher rigidity in order to be able to reliably provide the rotational fixation to the roll core.

Advantageously, the invention provides that the fiber content of the covering layer can vary, in particular, decrease radially from the inside to the outside. Thus, the fiber content in the radially outer region of the covering layer can preferably essentially be equal to zero.

As a result of the variation in the fiber content of the covering layer radially from the inside to the outside, the covering layer can have a coefficient of thermal expansion which is also different in a radial direction from the inside to the outside according to the fiber content. This is because the matrix material usually has a much higher coefficient of thermal expansion than the fiber material used. Accordingly, this means that the resulting coefficient of thermal expansion of the matrix material permeated with fibers is dependent on both the coefficient of thermal expansion of the matrix material and that of the fibers. Thus, the more fibers that are embedded in the matrix material, the more the resulting coefficient of thermal expansion approaches the coefficient of thermal expansion of the fibers used. In this way, it is possible to adjust the coefficient of thermal expansion of the radially inner region of the covering layer so that it has the same order of magnitude as the coefficient of thermal expansion of the roll core. Therefore, when the roll heats up in operation, the radially inner region of the covering lay-c can thus only expand slightly more than the roll core so that a relatively low relative displacement arises between the elastic covering layer and the roll core.

However, as a high fiber content also substantially increases the rigidity of the covering layer, the fiber content in the radially outer regions of the covering layer must be chosen to be lower. Otherwise, the surface of the roll may be too hard and may not be suitable for satining. By utilizing a fiber content within the covering layer which decreases radially towards the outside and in particular substantially continuously radially towards the outside, a situation can be achieved in which when the roll heats up, the longitudinal stresses which occur inside the covering layer and which are due to the different thermal expansions of the different regions are at no point so large that a peeling or destruction of the covering layer occurs.

In order to produce an elastic roll in accordance with the invention, the elastic covering layer is longitudinally displaceably, but rotationally fixedly applied onto a roll core. For example, the elastic covering layer can be shrunk, e.g. shrunk fit, onto the roll core so that a press fit arrangement of the elastic covering layer on the roll core is achieved.

Moreover, a separation layer can be applied prior to the application of the elastic covering layer onto the roll core. Accordingly, this can be performed, in particular, to reduce friction between the covering layer and the roll core.

However, any conventional method can be utilized in which the elastic covering layer is applied and/or installed to the roll core rotationally fixedly as long as it is also longitudinally displaceable and/or, in particular, free from play. For example, the roll can be made by pushing a prefabricated, tube-shaped covering layer onto the roll core.

The invention provides that a plurality of fibers can, for example, be wound on the roll core, in particular in multiple fiber layers one over the other, to produce the covering layer. In a similar way, it is possible to wind the fibers onto a coil former, in particular, onto a cylindrical coil former, which is pulled out of the wound covering layer at the end of the winding process.

The fibers can in each case be wound in the form of one or more fiber bundles and/or fiber rovings and/or fiber fleeces. In this case, it may be advantageous here for the fibers to be enveloped by the matrix material, in particular to be drawn through a matrix bath, prior to the winding. Generally, however, it is also possible for the fibers to be wound on in an essentially dry state and for the matrix material to be applied to them during or after winding, in particular for them to be completely embedded in the matrix material.

The invention therefore provides for a roll for smoothing of a material web comprising a hard roll core having an outside surface, and an covering layer comprising an elastic matrix material and disposed on the outside surface, wherein the covering layer is rotationally fixed and longitudinally displaceable on the hard roll core. The material web may be a paper web. The hard roll core may comprise a metal. The covering layer may be rotationally fixed and longitudinally displaceable relative to the outside surface of the hard roll core. The covering layer may comprise an inside diameter which substantially corresponds to an outside diameter of the hard roll core. The covering layer may be disposed on the hard roll core so as to be free from play. The covering layer may be force fit onto the hard roll core. The roll may further comprise a separation layer disposed between the outside surface of the hard roll core and the covering layer. The separation layer may reduce friction between the covering layer and the outside surface of the hard roll core. The separation layer may comprise silicone. The separation layer may comprise an essentially monomolecular layer. The separation layer may comprise one of a corrosion-inhibiting material and corrosion-preventing material. A coefficient of thermal expansion of the covering layer may be greater than a coefficient of thermal expansion of the hard roll core.

The roll may further comprise a plurality of guide elements engaging each of the covering layer and the hard roll core, the guide elements being positioned to guide the longitudinal displacement of the covering layer and to rotationally fix the covering layer of the hard roll core. The roll may further comprise at least one guide element disposed on the surface of the hard roll core, and at least one counter-element disposed on the covering layer, wherein the at least one guide element is positioned to engage the at least one counter-element disposed on the covering layer, and wherein the covering layer is longitudinally displaceable and rotationally fixed on the hard roll core via engagement of the at least one guide element and the at least one counter-element. The at least one counter-element may be disposed on a radially inner surface of the covering layer, and comprises a longitudinal guide which extends essentially in an axial direction, and wherein the at least one guide element comprises a pin-like engaging element that is arranged to project from the surface of the hard roll core and to engage the longitudinal guide disposed on the covering layer. At least one longitudinal guide may be disposed on the surface of the hard roll core and at least one engaging element is disposed on the covering layer. The covering layer may comprise at least one fiber layer which is embedded in the elastic matrix material. The at least one fiber layer may comprise a plurality of fiber layers, and wherein at least one of the plurality of fiber layers is formed at least partially by fiber bundles. The fiber bundles may be arranged to run obliquely relative to the surface of the hard roll core. The fiber bundles may comprise crossed fiber bundles. The covering layer may comprise a radially outer functional layer and a radially inner connection layer, and wherein the connection layer connects the functional layer to the hard roll core. At least one of the connection layer and the functional layer comprises a fiber content. The connection layer and the functional layer may comprise a fiber content. The fiber content of the connection layer may be higher than the fiber content of the functional layer. A fiber content in a radially outer region of the connection layer may be essentially equal to a fiber content of a radially inner region of the functional layer. The fiber content may be quantified in one of number of fibers, volume of fibers and percentage of fibers.

The covering layer may comprise a fiber content, and wherein the fiber content of the covering layer varies radially outwardly. The fiber content of the covering layer may decrease radially outwardly. The fiber content in a radially outer most region of the covering layer may be essentially equal to zero. The fiber content may comprise fiber layers. The fiber layers may comprise at least one of glass, aramide, and carbon fibers. The elastic matrix material may comprise a plastic. The plastic may comprise one of a thermosetting plastic and a thermoplastic. The elastic matrix material may comprise a resin and a hardener combination.

The invention also provides for a process for making a roll for smoothing a material web, the roll comprising a hard roll core having an outer surface and an elastic covering layer which includes an elastic matrix material, the method comprising applying the elastic covering layer on the outer surface of the hard roll core, wherein the elastic covering layer is rotationally fixed and longitudinally displaceable on the outside surface of the hard roll core. The material web may be a paper web. The hard roll core may comprise a metal. The applying may comprise shrinking the covering layer onto the hard roll core. The applying may comprise shrink fitting the covering layer onto the hard roll core.

The process may further comprise providing a separation layer between the elastic covering layer and the hard roll core, wherein the separation layer is adapted to educe friction between the covering layer and the hard roll core. The separation layer may be provided prior to the applying of the elastic covering layer. The process may further comprise forming the elastic covering layer with a plurality of fibers wound onto a cylindrical coil former. The plurality of fibers may comprise multiple fiber layers wound one over another. The process may further comprise forming the elastic covering layer with a plurality of fibers wound onto the hard roll core. The plurality of fibers may comprise multiple fiber layers wound one over another. The at least one of the multiple fiber layers may comprise at least one of a fiber bundle, a fiber roving, and a fiber fleece, wherein the fiber roving comprises a plurality of adjacent fibers of the same kind. At least one of the multiple fiber layers may comprise at least one of a fiber bundle, a fiber roving, and a fiber fleece, wherein the fiber roving comprises a plurality of adjacent fibers of the same kind. The elastic matrix material may envelope the plurality of fibers. The plurality of fibers may be drawn through a matrix bath prior to winding. The elastic matrix material may envelope the plurality of fibers. The plurality of fibers may be drawn through a matrix bath prior to winding. The winding of the plurality of fibers may further comprise winding the plurality of fibers onto the hard roll core in an essentially dry state.

The process may further comprise applying the elastic matrix material to the plurality of fibers in the essentially dry state during winding, wherein the fibers are completely embedded in the matrix material. The forming may comprise applying the elastic matrix material to the plurality of fibers in the essentially dry state after winding, wherein the fibers are completely embedded in the matrix material. The plurality of fibers may be wound in one of an oblique manner and a crossed manner. The plurality of fibers may comprise one of glass, aramide, and carbon fibers. The plurality of fibers may be wound in one of an oblique manner and a crossed manner. The plurality of fibers may comprise one of glass, aramide, and carbon fibers.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
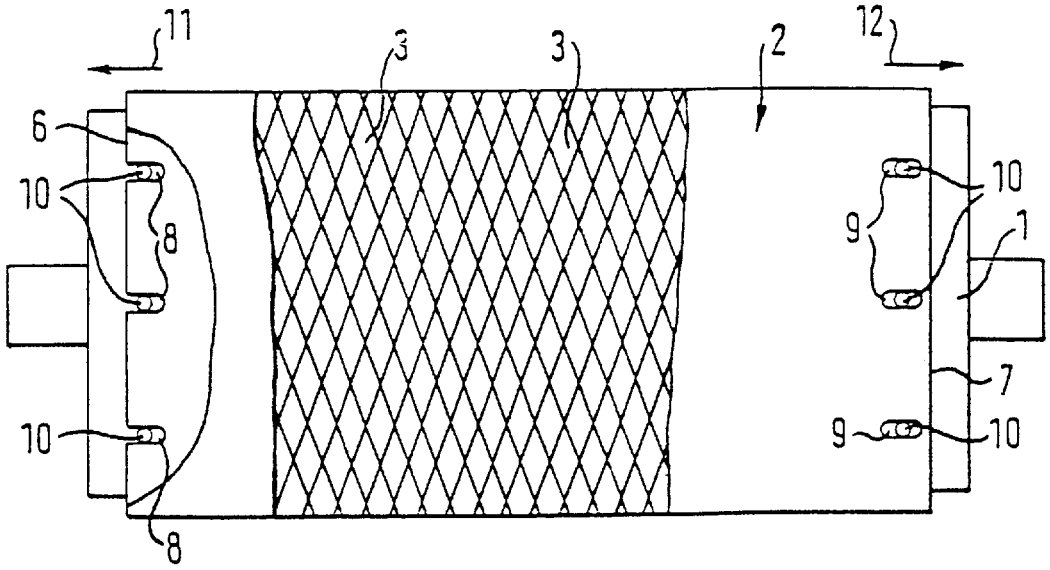
FIG. 1 is a side view in a partially cut-away illustration of a roll designed in accordance with the invention.

The roll in accordance with the invention shown in FIG. 1 includes a roll core 1, on the outside of which an elastic covering layer 2 is provided.

As can be seen from the central region of covering layer 2 shown partially cut-away, covering layer 2 includes a plurality of fiber bundles 3 which may include, e.g., carbon and/or glass and/or aramide fibers and/or other similar fibers. Moreover, these may be wound on roll core 1. Additionally, they may be wound e.g., in an essentially parallel manner in one layer and obliquely thereto in the next layer. Covering layer 2 may also be formed from a plurality of such fiber layers 4 (FIG. 2) formed by fiber bundles 3. These may be, for example, between approximately 10 and approximately 50 fiber layers 4.

Fiber layers 4 can be embedded in an elastic matrix material 5 (FIGS. 2–4) to form, elastic covering layer 2. Covering layer 2 receives the elasticity it requires through elastic matrix material 5, with fiber bundles 3 generating the required rigidity of covering layer 2.

The invention also may utilize slot-like longitudinal recesses 8, 9 which are formed on faces 6, 7 of elastic covering layer 2. Longitudinal recesses 8, 9, as is indicated by the cut-away illustration in e.g., FIG. 2, with respect to recesses 8, need not extend through the total thickness of elastic covering layer 2. Instead, they may be designed as hollows, e.g., indentations, cavities, blind holes, blind apertures etc., which are formed on the inside of elastic covering layer 2. However, longitudinal recesses 8, 9 can also extend through the total thickness of elastic covering layer 2, as is shown by way of example in regards to longitudinal recesses 8, 9 in FIGS. 1 and 4. Moreover, the invention also contemplates a combination of these features, e.g., wherein longitudinal recesses 8 extend through the entire thickness while longitudinal slots 9 are hollows and vice versa. The invention further contemplates that longitudinal recesses 8 may be a combination of hollows and slots which extend through the entire thickness, e.g., arranged in an alternating configuration wherein every other recess is a through slot with a hollow disposed therebetween and vice versa. Moreover, this same design or configuration may also apply to longitudinal slots 9.

In addition, both a laterally open design of longitudinal recesses 8 and a laterally closed design of the longitudinal recesses 9 are possible as is a combination of these.

Pin-like engaging elements 10 formed and/or disposed on the surface of roll core 1, engage into longitudinal recesses 8, 9. These pin-like engaging elements 10 may have a diameter essentially corresponding to the open width of longitudinal recesses 8, 9 present in the circumferential direction of covering layer 2, i.e., with or without a small amount of clearance between the pin diameter and the recess width. In this way, with pin-like engaging elements 10 being disposed in longitudinal recesses 8, 9, any twisting of elastic covering layer 2 on roll core 1 is significantly reduced and/or prevented.

However, due to longitudinal recesses 8, 9 being designed in an elongated manner and aligned in and/or arranged parallel to an axial direction, longitudinal displacement of elastic covering layer 2 on roll core 1 is possible. Such movement is designated in the direction of arrows 11, 12. In this regard, elastic covering layer 2 is not adhered to role core 1, but is instead disposed to be freely movable thereon.

When the roll heats up, such as occurs in operation, elastic covering layer 2 is allowed to expand in an axial direction more than roll core 1. This is due to its greater coefficient of thermal expansion in comparison with roll core 1, so that end faces 6, 7 of elastic covering layer 2 are displaced in the direction of arrows 11, 12 respectively. As a result of this movement, none or very little stress occurs between roll core 1 and elastic covering layer 2 due to the different expansions.

With fiber bundles 3 being disposed in a crossed arrangement, construction, or assembly, any torsion of covering layer 2 is reliably prevented despite the free support of elastic covering layer 2 on roll core 1.

Figure 2:
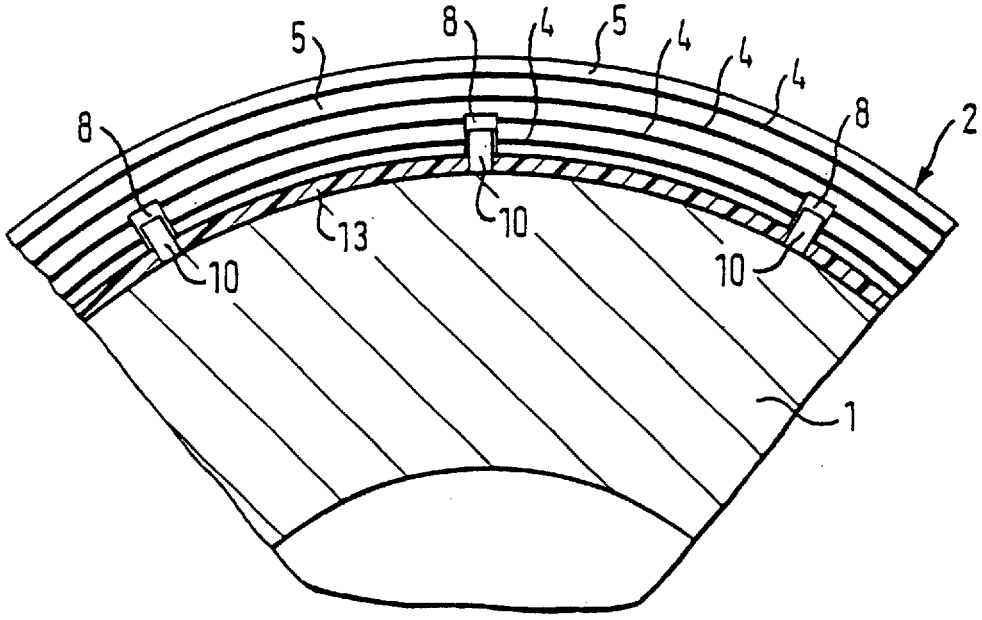
FIG. 2 is a partial cross-section through one end of the roll designed in accordance with the invention of FIG. 1.
Figure 3:
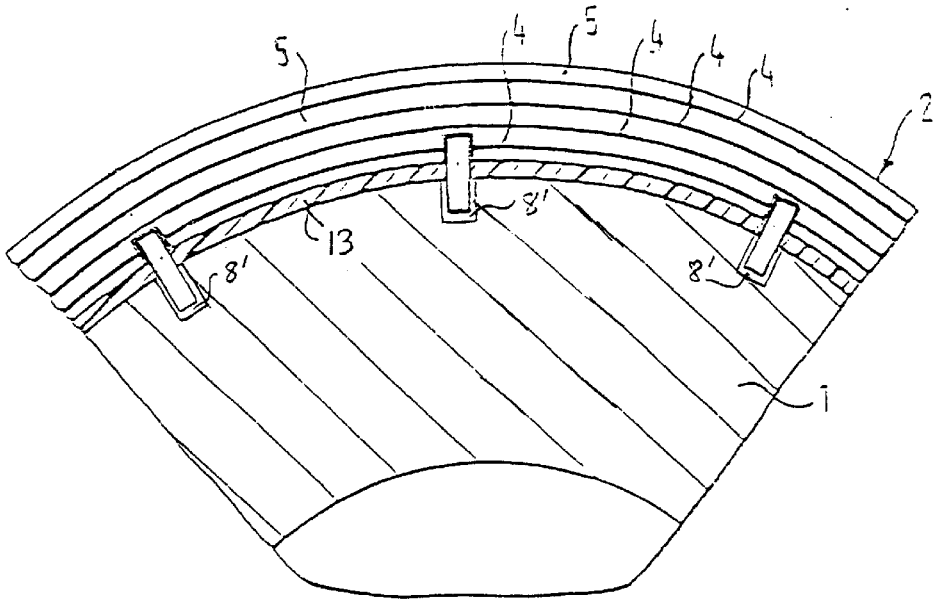
FIG. 3 is a partial cross-section through another embodiment of a roll.
Figure 4:
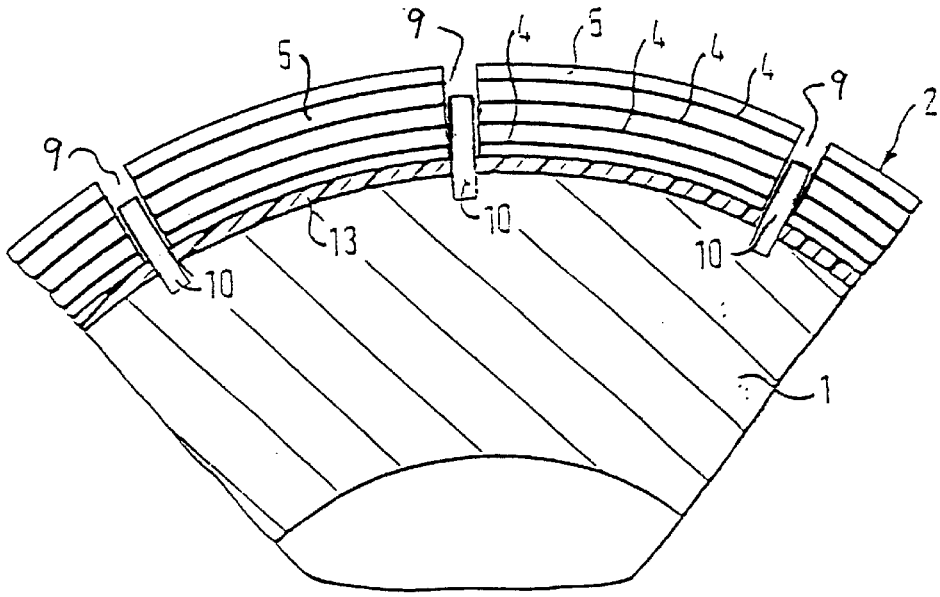
FIG. 4 is a partial cross-section through the other end of the roll designed in accordance with the invention of FIG. 1.

As can be seen from FIGS. 2–4, a thin separation layer 13, e.g., a material including silicone, can be disposed between roll core 1 and elastic covering layer 2. Further, separation layer 13 can also act a lubricant so that elastic covering layer 2 is allowed to be longitudinally displaced in an axial direction on roll core 1. This movement should occur despite the fact that covering layer 2 may be force fit onto roll core 1. In addition, separation layer 13 can also include a corrosion-inhibiting or corrosion-preventing material, so that the surface of roll core 1 can be protected against corrosion.

The invention also contemplates the possibility that roll core 1 includes recesses while covering layer 2 has pin-like engaging elements 10, e.g., FIG. 3, as well as various combinations of these features.

Furthermore, it should be noted that pin-like engaging elements 10 may be permanently fixed to roll core 1 or alternatively made removable there from, e.g., FIG. 4. In this regard, pin-like engaging elements 10 may be removably retained in and/or on roll core 1 by various mechanisms such as press fitting, threaded engagement, bonding, etc.

Still further, the invention also contemplates that a single row of pin-like engaging elements 10 may be utilized on roll core 1, e.g., such as one located in the approximate center of the length of roll core 1 (not shown). Accordingly, in such an embodiment, recesses 8, 9/pin-like engaging elements 10 would also be located in the approximate center of the length of roll core 1/covering layer 2. Moreover, this embodiment may or may net require additional recesses 8,9/pin-like engaging elements 10 to be located near end faces 6, 7.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Reference Numeral List

1 Roll core
2 Elastic covering layer
3 Fiber bundles
4 Fiber layers
5 Elastic matrix material
6 End face
7 End face
8 Longitudinal recesses
9 Longitudinal recesses
10 Pin-like engaging elements
11 Arrow
12 Arrow
13 Separation layer

What is claimed:

1. A roll for smoothing of a material web comprising:

a hard roll core having an outside surface;

a covering layer comprising a cylinder of elastic matrix material, the cylinder having an inside cylindrical surface, a diameter, and a length which is greater than the diameter;

the inside cylindrical surface being disposed on the outside surface; and the covering layer comprising a plurality of wound fiber layers that are each embedded in the elastic matrix material, wherein the covering layer is rotationally fixed and longitudinally displaceable on the hard roll core in operation and when the inside cylindrical surface is disposed adjacent the outside surface of the hard roll core, wherein the roll is a smoothing material web roll.

2. The roll of claim 1, wherein the material web is a paper web.

3. The roll of claim 2, wherein the hard roll core comprises a metal.

4. The roll of claim 1, wherein the covering layer comprises an inside diameter which substantially corresponds to an outside diameter of the hard roll core.

5. The roll of claim 1, wherein the covering layer is disposed on the hard roll core so as to be free from play.

6. The roll of claim 5, wherein the covering layer is force fit onto the hard roll core.

7. The roll of claim 1, further comprising a separation layer disposed between the outside surface of the hard roll core and the covering layer.

8. The roll of claim 7, wherein the separation layer reduces friction between the covering layer and the outside surface of the hard roll core.

9. The roll of claim 7, wherein the separation layer comprises silicone.

10. The roll of claim 7, wherein the separation layer comprises an essentially monomolecular layer.

11. The roll of claim 7, wherein the separation layer comprises one of a corrosion-inhibiting material and corrosion-preventing material.

12. The roll of claim 1, wherein a coefficient of thermal expansion of the covering layer is greater than a coefficient of thermal expansion of the hard roll core.

13. The roll of claim 1, further comprising a plurality of guide elements engaging each of the covering layer and the hard roll core, the guide elements being positioned to guide the longitudinal displacement of the covering layer and to rotationally fix the covering layer of the hard roll core.

14. The roll of claim 1, further comprising at least one guide element disposed on the surface of the hard roll core, and at least one counter-element disposed on the covering layer, wherein the at least one guide element is positioned to engage the at least one counter-element disposed on the covering layer, and wherein the covering layer is longitudinally displaceable and rotationally fixed on the hard roll core via engagement of the at least one guide element and the at least one counter-element.

15. The roll of claim 14, wherein the at least one counter-element is disposed on a radially inner surface of the covering layer, and comprises a longitudinal guide which extends essentially in an axial direction, and wherein the at least one guide element comprises a pin-like engaging element that is arranged to project from the surface of the hard roll core and to engage the longitudinal guide disposed on the covering layer.

16. The roll of claim 1, wherein at least one longitudinal guide is disposed on the surface of the hard roll core and at least one engaging element is disposed on the covering layer.

17. The roll of claim 1, wherein at least one of the plurality of fiber layers is formed at least partially by fiber bundles.

18. The roll of claim 17, wherein the fiber bundles are arranged to run obliquely relative to the surface of the hard roll core.

19. The roll of claim 17, wherein the fiber bundles comprise crossed fiber bundles.

20. The roll of claim 1, wherein the covering layer comprises a radially outer functional layer and a radially inner connection layer, and wherein the connection layer connects the functional layer to the hard roll core.

21. The roll of claim 20, wherein at least one of the connection layer and the functional layer comprises a fiber content.

22. The roll of claim 20, wherein the connection layer and the functional layer comprises a fiber content.

23. The roll of claim 22, wherein the fiber content of the connection layer is higher than the fiber content of the functional layer.

24. The roll of claim 20, wherein a fiber content in a radially outer region of the connection layer is essentially equal to a fiber content of a radially inner region of the functional layer.

25. The roll of claim 24, wherein the fiber content is quantified in one of number of fibers, volume of fibers and percentage of fibers.

26. The roll of claim 1, wherein the covering layer comprises a fiber content, and wherein the fiber content of the covering layer varies radially outwardly.

27. The roll of claim 26, wherein the fiber content of the covering layer decreases radially outwardly.

28. The roll of claim 26, wherein the fiber content in a radially outer most region of the covering layer is essentially equal to zero.

29. The roll of claim 26, wherein the fiber content comprises the plurality of wound fiber layers.

30. The roll of claim 29, wherein the fiber layers comprise at least one of glass, aramide, and carbon fibers.

31. The roll of claim 1, wherein the elastic matrix material comprises a plastic.

32. The roll of claim 31, wherein the plastic comprises one of a thermosetting plastic and a thermoplastic.

33. The roll of claim 1, wherein the elastic matrix material comprises a resin and a hardener combination.

34. A roll for smoothing of a material web comprising:

a roll core comprising an outside cylindrical surface having a first length;

a cylindrical covering layer comprising a single cylinder of elastic matrix material having an inside cylindrical surface, an outside cylindrical surface, and a second length;

the cylindrical covering layer comprising a plurality of wound fiber layers that are each embedded in the elastic matrix material;

the inside cylindrical surface having a second length and being adapted to receive the outside cylindrical surface of the roll core;

the first length being greater than the second length; and the covering layer being rotationally fixed and longitudinally displaceable on the roll core in operation and when the inside cylindrical surface is disposed adjacent the outside cylindrical surface of the roll core, wherein the roll is a smoothing material web roll.

35. A roll for smoothing of a material web comprising:

a roll core comprising an outside cylindrical surface;

a cylindrical covering layer comprising a single cylinder of elastic matrix material having an inside cylindrical surface, an outside cylindrical surface, and a plurality of hollows wherein the hollows comprise one of indentations, cavities, blind bores and blind apertures;

the cylindrical covering layer comprising a plurality of wound fiber layers that are each embedded in the elastic matrix material;

the inside cylindrical surface being adapted to receive the outside cylindrical surface of the roll core;

a plurality of engaging elements projecting from the outside cylindrical surface;

the plurality of engaging elements preventing the covering layer from rotating with respect to the roll core; and the covering layer being longitudinally displaceable in operation with respect to the roll core, wherein the roll is a smoothing material web roll.

* * * * *